United States Patent [19]

Row

[11] 4,118,035

[45] Oct. 3, 1978

[54] MATRIX GAME APPARATUS

[76] Inventor: Deborah Row, Box 301, Point Pleasant, Pa. 18950

[21] Appl. No.: 745,734

[22] Filed: Nov. 29, 1976

[51] Int. Cl.[2] ..... A63F 3/00

[52] U.S. Cl. ..... 273/243; 273/240; 273/269; 273/271

[58] Field of Search ..... 273/134, 135, 135 AC, 273/135 AA, 135 B, 135 R, 134 C, 134 AD, 130 B, 135 BC, 240, 269, 270, 271, 243, 134 D

[56] References Cited

U.S. PATENT DOCUMENTS

| | | | |
|---|---|---|---|
| 1,425,617 | 8/1922 | Terry | 273/135 BC |
| 3,149,842 | 9/1964 | Cirrincione | 273/136 C |
| 3,374,558 | 3/1968 | Smith, Jr. | 273/136 C |
| 3,633,914 | 1/1972 | Solomon | 273/135 B |
| 3,705,727 | 12/1972 | Breslow | 273/135 AA X |
| 3,749,404 | 7/1973 | Oetzel | 273/135 B |
| 3,984,107 | 10/1976 | Nelson | 273/135 B |

FOREIGN PATENT DOCUMENTS

| | | | |
|---|---|---|---|
| 673,136 | 6/1952 | United Kingdom | 273/135 AA |

*Primary Examiner*—Richard C. Pinkham
*Assistant Examiner*—Harry G. Strappello
*Attorney, Agent, or Firm*—Michael F. Petock

[57] ABSTRACT

An apparatus for playing an educational and entertaining game concerning the use of a matrix and astrology which includes a game board having a plurality of circularly consecutively arranged segments. Each of said plurality of segments is identified with either a sign of the zodiac, a starting segment, an astrological element or a neutral segment. The segments identified with the signs of the zodiac are further identified with one of the characteristics of the particular sign of the zodiac. A means of chance and a playing piece for each player of the game is provided. A plurality of cards is provided with there being one card for each combination of a zodiac sign and characteristic. A score card is provided for each player. The score card is comprised of a grid with areas located in the grid identified by the zodiac signs along one side and the characteristics along a perpendicular side whereby particular areas may be allocated in response to the player obtaining a particular sign and characteristic by use of the means of chance and the playing board or the cards whereby particular designs may be formed on the score cards. The winner of the game is the first player to form a selected zodiac sign on the score card and meet other conditions for winning required by the game, such as disposing of all extra cards. The matrix score card and the creation of other designs on the matrix to form a winning combination may be used with game apparatus in general, not limited to the field of astrology.

14 Claims, 7 Drawing Figures

FIG. 1
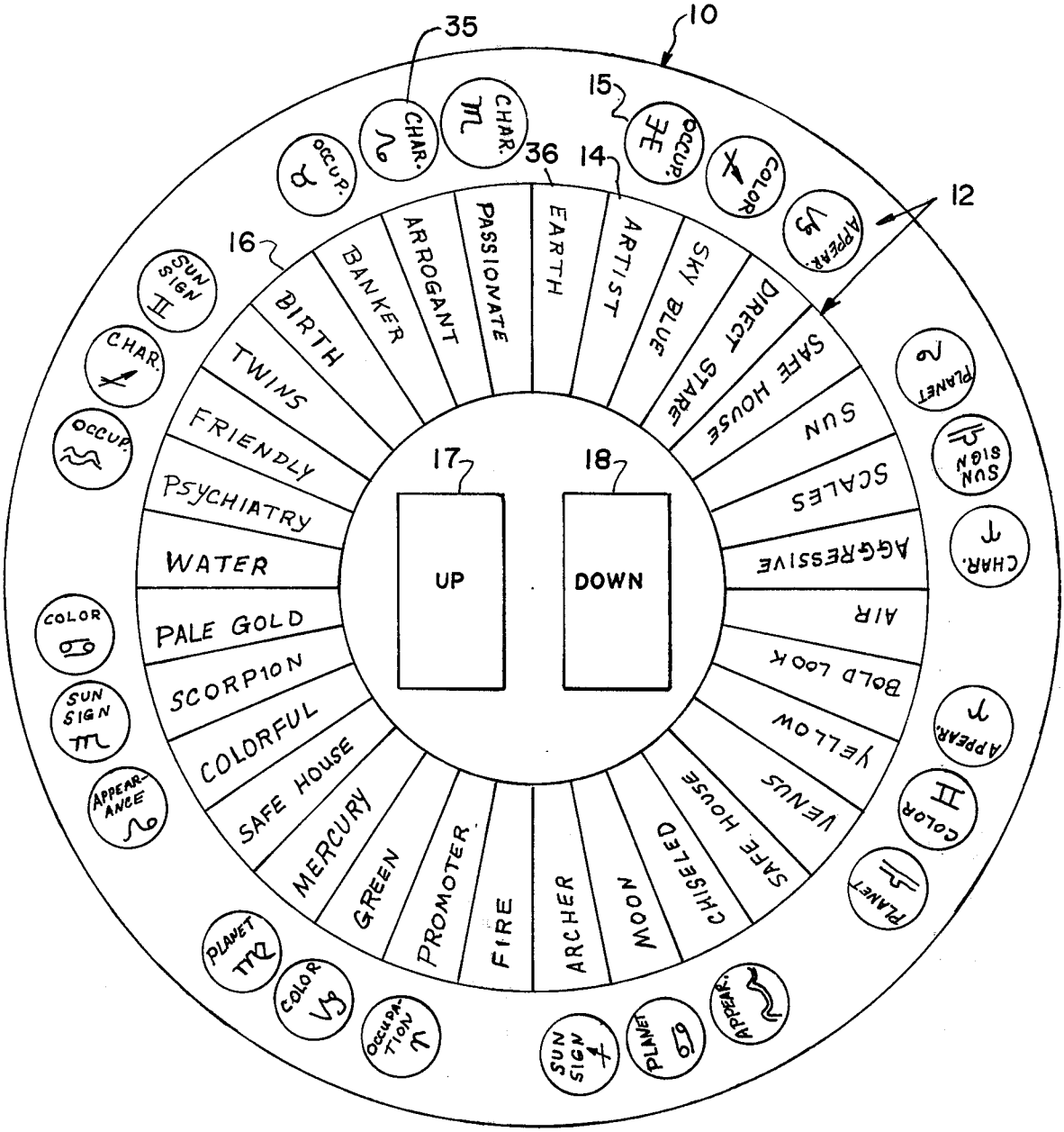
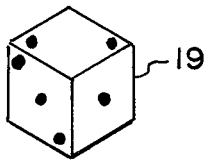
FIG. 6
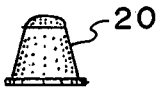
FIG. 7

MATRIX GAME APPARATUS

BACKGROUND OF THE INVENTION

The present invention relates to a matrix game apparatus. More particularly, the present invention relates to an astrological game apparatus in which winning designs are formed on a matrix score card and which is interesting, educational and entertaining.

There has been a need for an interesting, educational and entertaining game of astrology which provides an educational association between the various signs of the zodiac and their characteristics. The present invention provides a grid type score card in which the winner of the game is at least partially determined by the player being able to complete a sign of the zodiac on his grid score card. The game includes a game board and a deck of cards which associate various characteristics with the several zodiac signs.

Applicant has become aware of U.S. Pat. No. 3,785,654 which discloses an astrological game board apparatus which does not use the associated characteristics of the zodiac signs nor the grid type score card and which is completely different in nature from the invention disclosed herein.

SUMMARY OF THE INVENTION

The present invention provides apparatus for playing an educational and entertaining game in which game means are provided for producing by means of chance sets of combinations of elements of a first type and elements of a second type. The apparatus includes a score card for each player which is comprised of a grid with areas located in the grid being identified by elements of the first type along one side and elements of the second type along a perpendicular side. Particular areas may be allocated or darkened in response to the player obtaining particular combinations of elements of the first and second types by the use of the game means whereby particular designs may be formed on the score card.

A preferred embodiment of the present invention provides an interesting, educational and entertaining game concerning astrology in which the winner of the game is at least partially determined by being able to complete the formation of a zodiac sign on a grid in response to the player obtaining particular zodiac signs and characteristics of the zodiac by use of the means of chance, playing board and the cards.

Briefly and basically, a preferred embodiment of the apparatus of the game as applied to astrology comprises a game board having a plurality of consecutively arranged segments. Each of the plurality of segments is allocated to one of the signs of the zodiac, a starting segment, the four astrological elements and a predetermined number of neutral segments. The segments allocated to the signs of the zodiac are further identified with a characteristic of the particular sign of the zodiac. A means of chance or chance determining means and a playing piece means for each player are provided. A deck or set of cards is provided with each card being identified with a combination of one of the signs of the zodiac and one of the characteristics of that zodiac sign. A score card is provided for each player. The score card is comprised of a grid with areas located in the grid identified by the zodiac signs along one side and characteristics along a perpendicular side whereby particular areas may be allocated in response to the player obtaining a particular sign and characteristic by use of the means of chance and the playing board or the cards whereby particular designs may be formed on the score card.

In a preferred embodiment, the winner is determined by the first player to be able to complete a selected zodiac sign on his grid score card and to get rid of all cards in his possession in accordance with the rules of the game. In one embodiment, a means of chance is provided for aiding in the selection or assignment of the zodiac signs to the various players. In a case where there are four or less players, four cards, called "fate" cards are provided, one for each of the four astrological elements. One of these cards is randomly dealt to or selected at random by each player. Each "fate" card is identified with a particular astrological element which then limits that player's choice of zodiac sign selection to one of the three zodiac signs associated with that astrological element. For example, if the player selects the "fate" card designated "FIRE", the player must select to try to complete one of the zodiac signs corresponding to Aries, Leo or Sagittarius on his score card.

Although the game apparatus of the present invention has been disclosed in the context of a specific astrological game, it is understood that the score card matrix of the present invention may be used in conjunction with various game apparatus which include means of chance to select combinations of elements of a first and a second type. The score card may be comprised of a grid with areas located in the grid identified by elements of the first type along one side and elements of a second type along a perpendicular side. Particular areas of the score card may be allocated or darkened, such as by use of a pencil, in response to a player obtaining a particular combination of elements of the first and second types by use of the means of chance. In this manner particular designs may be formed on the score card.

For example, the score card may be comprised of a predetermined number ($n$) of elements of a first type as indicia along one side of the score card grid. A second predetermined number ($m$) of elements of a second type may be used as indicia along a perpendicular side of the score card grid. Game means which includes means of chance may be used to select combinations of elements of the first and second type. For example, the means of chance may comprise a deck of cards containing all possible combinations of the first and second set of elements. In other words, this would comprise a deck of cards of $(n)(m)$ cards.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a plan view of the game board of the present invention.

FIG. 6 is a view in perspective of a means of chance in accordance with the present invention.

FIG. 7 is an elevation view of a playing piece for the game.

DETAILED DESCRIPTION OF A PREFERRED EMBODIMENT

Figure 2:
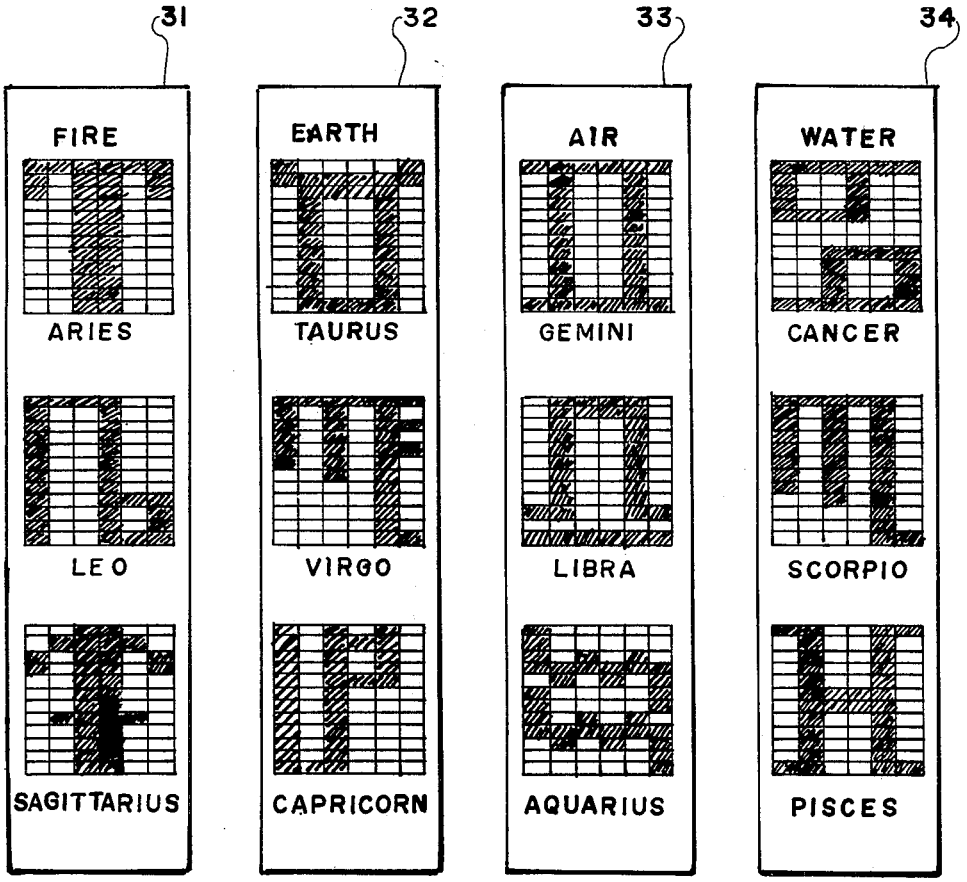
FIG. 2 is a plan view of four guide cards used in accordance with the game of the present invention.

Although the present invention will be described primarily with respect to a preferred embodiment in the form of an astrological game, it is understood that the game apparatus of the present invention, may be used in conjunction with various types of games in which a design is formed on the matrix in response to combinations of a first and second type of element being selected by a means of chance.

Referring now to the drawings, there is shown in FIG. 1, a game board 10 having a plurality of circularly arranged consecutive segments 12. Broadly, the segments include the segment section 14 and the zodiac sign 15 where it appears. Although the segments are shown to be preferably circularly arranged, it is understood that for the purpose of playing the game, the segments need not be circularly arranged, so long as they are consecutively arranged. For example, the segments could possibly be arranged in a square, rectangular or other suitable shape.

As shown in FIG. 1, there are thirty-two segments 12. The starting segment 16 is denominated BIRTH. The four astrological elements, earth, air, fire and water are allocated to four segments. There are also three neutral positions or segments, designated as SAFE HOUSE on the board. The remaining segments of the thirty-two segments shown, are allocated to zodiac signs and one of six characteristics of the zodiac signs, which for the purpose of the game have been chosen to be character, color, occupation, planet, appearance and sun sign. The game board is also useful as an educational apparatus as it teaches players using the game characteristics associated with the zodiac signs.

Figure 5:
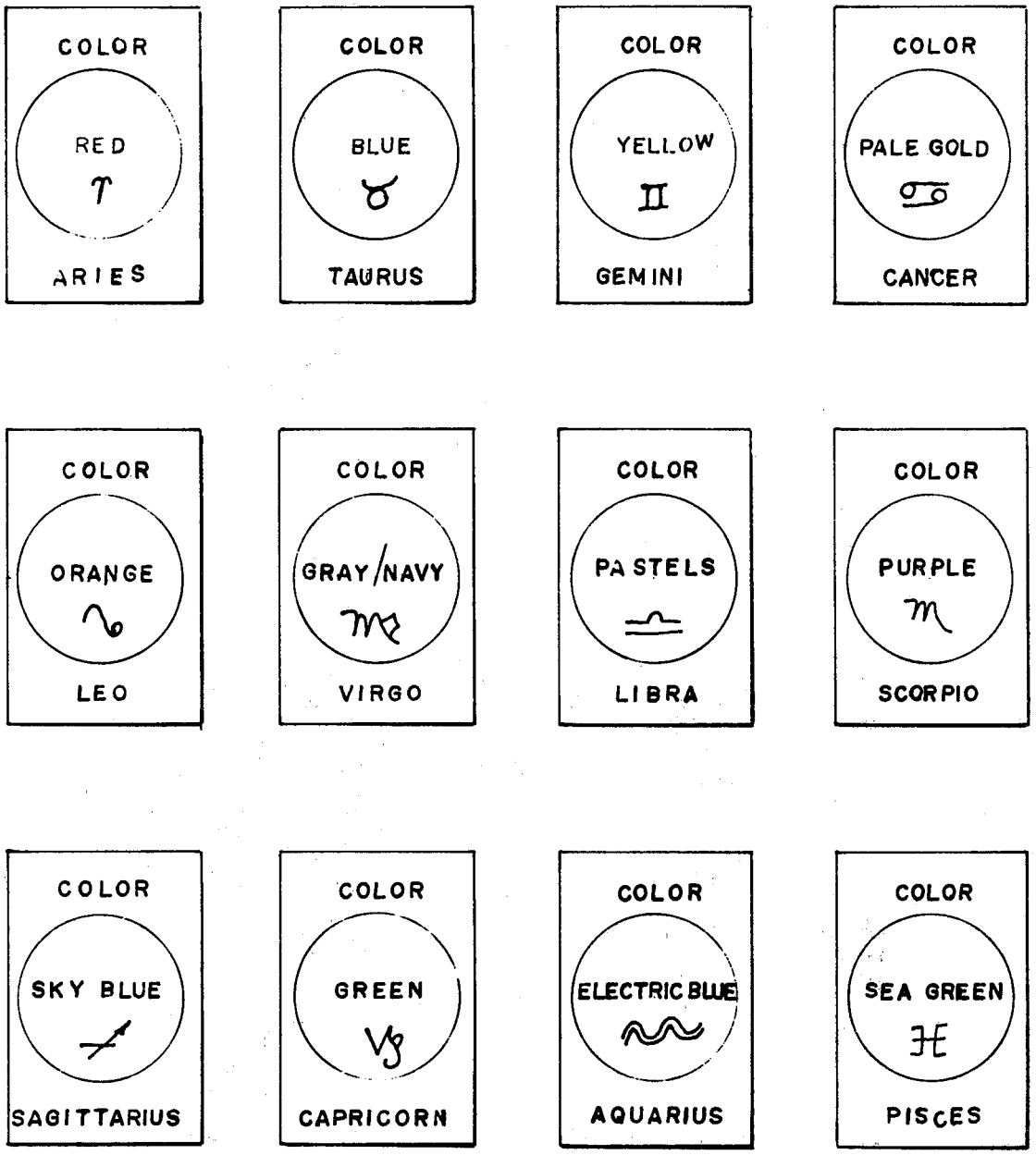
FIG. 5 shows typical cards from the deck of cards, illustrating the cards for the characteristic color of each of the twelve signs of the zodiac.

The game board 10 is also provided with two positions 17 and 18. Position 17 being designated up and position 18 being designated down. Positions 17 and 18 are for the placement of cards, some of which are shown in FIG. 5.

A means for determining a chance result or a chance determining means is shown in FIG. 6 in the form of a single die 19. The die 19 provides a means of chance providing possible numbers 1 through 6. A single die 19 is a convenient and preferred means of chance, however, it is understood that any other suitable means of chance, such as an arrow on a spinner, may be used to provide a suitable means of chance for the numbers 1 through 6.

In FIG. 7, there is shown a playing piece 20. The playing piece 20 is one form of any number of suitable playing piece means which may be used to mark a player's position on game board 10. The playing pieces used will preferably have a different shape or color for each player. Furthermore, various types of playing pieces may be used to mark each player's position.

Figure 4:
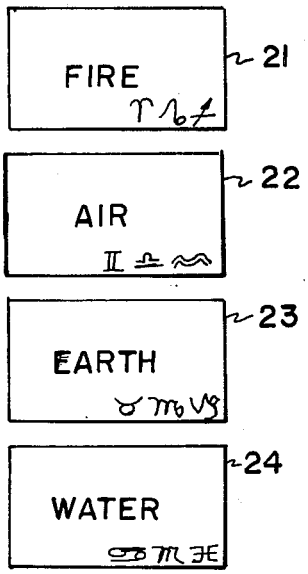
FIG. 4 shows the four fate cards used in accordance with the game of the present invention.
Figure 3:
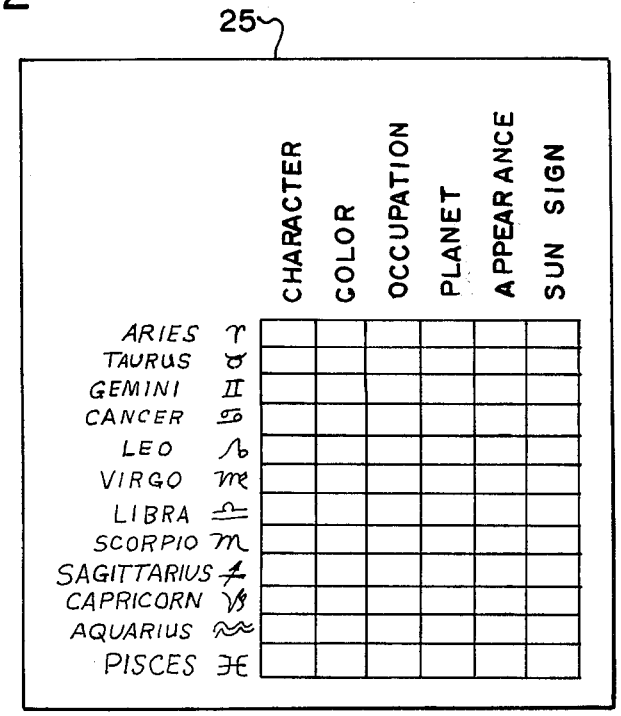
FIG. 3 is a plan view of a score card in accordance with the present invention.

Referring now to FIG. 4, there are shown four FATE cards 21, 22, 23 and 24. One of the fate cards corresponds to each of the four astrological elements, fire, air, earth and water. When there are four or less players, each player selects one of the fate cards 21, 22, 23 and 24 with the face of the fate cards being down. In other words, each player arbitrarily of blindly selects a card or the fate cards are shuffled and dealt to the players in a random manner. Once a particular fate card is selected, the player is then given the corresponding one of the guide cards 31, 32, 33 and 34 shown in FIG. 2. For example, if the first player selects fate card 21 for fire, he is given guide card 31 for fire which provides him with a guide to making the zodiac signs for Aries, Leo or Sagittarius. The player may then select any one of the signs shown on his guide card. In playing the game of the present invention, the player will try to fill in or cover the blocks of his grid type score card 25 shown in FIG. 3 in accordance with one of the signs shown on his guide card. The filling in of the score card may be done by pencil or other suitable marker or portions of the card may be covered by suitable means.

The cards shown in FIG. 5 are some of the typical cards of a deck of cards of the game. The cards shown in FIG. 5 are for the characteristic of the zodiac sign corresponding to color for each of the 12 zodiac signs. The following is a listing of the characteristics, particular characteristics and zodiac signs for a game comprised of six characteristics and the 12 zodiac signs. It is understood that more or less than six characteristics may be used in a game of this nature. However, the inventor herein has found that it is preferable to use the six characteristics identified herein.

| Characteristic | Particular Characteristic | Zodiac Sign |
|---|---|---|
| Character | Fearless | Aries |
| Character | Patient | Taurus |
| Character | Dual Personality | Gemini |
| Character | Sensitive | Cancer |
| Character | Gambler | Leo |
| Character | Methodical | Virgo |
| Character | Philosophical | Libra |
| Character | Possessive | Scorpio |
| Character | Confident | Sagittarius |
| Character | Successful | Capricorn |
| Character | Perceptive | Aquarius |
| Character | Changeable | Pisces |
| Color | Red | Aries |
| Color | Blue | Taurus |
| Color | Yellow | Gemini |
| Color | Pale Gold | Cancer |
| Color | Orange | Leo |
| Color | Gray/Navy | Virgo |
| Color | Pastels | Libra |
| Color | Purple | Scorpio |
| Color | Sky Blue | Sagittarius |
| Color | Green | Capricorn |
| Color | Electric Blue | Aquarius |
| Color | Sea Green | Pisces |
| Occupation | Promoter | Aries |
| Occupation | Designer | Taurus |
| Occupation | Author | Gemini |
| Occupation | Historian | Cancer |
| Occupation | Teacher | Leo |
| Occupation | Doctor | Virgo |
| Occupation | Librarian | Libra |
| Occupation | Detective | Scorpio |
| Occupation | Test Pilot | Sagittarius |
| Occupation | Businessman | Capricorn |
| Occupation | Psychologist | Aquarius |
| Occupation | Actor | Pisces |
| Planet | Mars | Aries |
| Planet | Venus | Taurus |
| Planet | Mercury | Gemini |
| Planet | Moon | Cancer |
| Planet | Sun | Leo |
| Planet | Mercury | Virgo |
| Planet | Venus | Libra |
| Planet | Pluto | Scorpio |
| Planet | Jupiter | Sagittarius |
| Planet | Saturn | Capricorn |
| Planet | Uranus | Aquarius |
| Planet | Neptune | Pisces |
| Appearance | Sharp Strong Features | Aries |
| Appearance | Well Proportioned Features | Taurus |
| Appearance | Ageless Appearance | Gemini |
| Appearance | Baby Face | Cancer |
| Appearance | Colorful Appearance | Leo |
| Appearance | Fragile Appearance | Virgo |
| Appearance | Attractive with Dimples | Libra |
| Appearance | Hypnotic Stare | Scorpio |
| Appearance | Open Cheerful Face | Sagittarius |

-continued

| Characteristic | Particular Characteristic | Zodiac Sign |
|---|---|---|
| Appearance | Serious Direct Stare | Capricorn |
| Appearance | Finely Chiseled Features | Aquarius |
| Appearance | Elastic Mobile Features | Pisces |
| Sun Sign | The Ram | Aries |
| Sun Sign | The Bull | Taurus |
| Sun Sign | The Twins | Gemini |
| Sun Sign | The Crab | Cancer |
| Sun Sign | The Lion | Leo |
| Sun Sign | The Virgin | Virgo |
| Sun Sign | The Scales | Libra |
| Sun Sign | The Scorpion | Scorpio |
| Sun Sign | The Archer | Saggitarius |
| Sun Sign | The Goat | Capricorn |
| Sun Sign | Water Bearer | Aquarius |
| Sun Sign | The Fish | Pisces |

Now that the apparatus of the game has been briefly explained, the method of playing the game will be described. The main object of the game is to check off, darken or otherwise allocate blocks on grid type score card 25 shown, in FIG. 3 to form a particular zodiac sign. If four or less than four persons are playing the game, the fate cards 21, 22, 23 and 24 are used to give each player a choice of three particular signs. If more than four are playing, the sign for each player is selected by a random means, such as picking out of a hat.

In order to play the game, the game board 10 is set out for use. A grid type score card 25 is given to each player. Assuming there are four or less players, the four fate cards 21, 22, 23 and 24 shown in FIG. 4 are shuffled and are dealt to the players. If there are less than four players, the remaining fate card is put aside and may be seen by all players. Once the fate cards are dealt out, each player takes a corresponding guide card 31, 32, 33 or 34 to serve as a guide to fill in on his score card with any one of three possible zodiac signs corresponding to that astrological element. For example, the player receiving the earth fate card 23 receives the earth guide card 32 providing him with a guide for any one of the zodiac signs Taurus, Virgo or Capricorn. Similarly, a person receiving the air fate card 22 would take the air guide card 33 providing him with a guide for the zodiac signs of Gemini, Libra and Aquarius. The player receiving the water fate card 24 would take the water guide card 34 providing him with a guide to the filling in of his score card in accordance with the zodiac signs for Cancer, Scorpio or Pisces. Each player may then select any one of the zodiac signs shown on his guide card. The grid shown on the guide card and the grid shown in the score card 25 are the same. That is, they are comprised of 72 spaces. Each space in the score card 25 is identified by the zodiac signs along one side and the six characteristics along a perpendicular side or axis. Therefore, with a particular zodiac sign and a particular characteristic, a particular space on the score card 25 is definitely located, identified or ascertained. The score card 25 may be preferably filled out by darkening in the spaces by means of a pencil. However, other means of allocating a particular space in the score card 25 may be used, such as paper elements, playing pieces, markers held by magnetic means or "Velcro" type fasteners, or any other suitable marking means.

In commencing the playing of the game, all players will start on segment 16, identified as "BIRTH" on board 10. The die is first rolled to determine in what order the players will proceed. This can be determined in a number of different manners, but one suitable way of doing it is for the players to proceed in accordance with the number received on the roll of the die. For example, the player receiving the second highest number goes second and so forth and so on.

It is understood that the rules of the game may be varied within the spirit of the teachings of this invention. However, the preferred embodiment and best mode of playing the game is as follows. The players proceed taking turns rolling the die. If a player at turn rolls a number 1 to 5 on the die, he can choose to move his playing piece 20 a number of segments 12 in a clockwise direction corresponding to the number which he rolled on the die, that is moved in a clockwise direction from starting segment BIRTH 16. However, a player does not need to move his playing piece 20 by the number of indicated spaces, but he may instead choose to pick up a number of face down cards, lying face down in position 18. The number of cards picked up would correspond to the number which was rolled on the die. The player may not both move his playing piece by the rolled number of places on the board and pick up the rolled number of cards. He must choose to do either one. The player who chooses to move to a designated segment on the board then fills in that particular space on his score card. For example, if a player starting on BIRTH, rolls a 2 on the die, as shown in FIG. 6, and he decides to move on the board 10, he would move to segment 35 on playing board 10 which is identified by the sign Leo and the characteristic Character, which is, the fifth space down from the top in the first column, identifying the columns by counting from the left of score card 25.

If the player decided to pick up a number of cards corresponding to the number rolled on the die, he would then fill in his score sheet accordingly, corresponding to the signs and characteristics on the cards which he picked up. Some of the cards are shown in FIG. 5. It is seen that the cards provide an educational function identifying particular characteristics with particular zodiac signs. The signs and characteristics of all of the cards are listed in the table above. The player does not have to fill in his score card in accordance with cards which do not help him achieve his objective of forming a particular zodiac sign on his score card. However, the cards he does use, he may get rid of by placing face up in the face up position 17 on playing board 10. The cards he does not use, he is stuck with. In order to win, the player must not only complete his zodiac sign on his score card 25, but he must also get rid of any cards in his possession. Cards may be gotten rid of by a player in four ways:

1. If another player rolls a six, each player then gives that player two cards or as many cards as he has, if he has less than two.

2. If a player lands on any of the three SAFE HOUSE's on the board, that player may place as many cards on the face up position 17 as the number which was thrown on the die (except for a 6, which is governed in accordance with 1 above).

3. If a player lands on a segment 12 on board 10 corresponding to his fate card (cards 21, 22, 23 and 24) element, he may put all of his cards on the face up card position 17. In other words, if a particular player had been dealt an earth fate card 23 at the start of the game, that player would then be an earth element or sign, and, if that player lands on earth segment 36 at any time during the game, that player may then get rid of all of his cards by placing them on the card face up position 17.

4. If a player lands on another player's fate card sign, that player may then give the player on whose fate card sign he landed two cards of his choice from his extra cards. If less than four players are playing, and the player lands on one of the astrological signs not belonging to another player, then the player landing on that astrological element or sign, such as earth, air, fire or water does not give up any cards and that segment is considered to be a rest spot similar in nature to that of BIRTH segment 16.

It will be apparent to those skilled in the art that various modifications may be made to the present invention. For example, the structure and concepts of the present invention may be readily modified to be applied to various types of games other than those dealing with astrology. The game board of the present invention may be modified to contain various combinations of elements of a first type and elements of a second type. Similarly, the playing cards may be modified so that each card represents a combination of one element of a first type and one element of a second type. It is apparent that the grid may be comprised of a structure in which the areas within the grid are located by any predetermined number of (*n*) elements of a first type along one side and any predetermined number of (*m*) elements of a second type along a perpendicular side. Of course, a preferred arrangement would have a reasonable number of elements along the two perpendicular sides. A very small number of elements along each side, such as one or two, limits the type of design which may be created on the matrix and a very large number of elements for example, in excess of thirty elements, along one or both sides, may make the playing time of the game unduly long and tedious. However, numerous suitable variations will be obvious to those skilled in the art.

In view of the above, the present invention may be embodied in other specific forms without departing from the spirit or essential attributes thereof, and accordingly, reference should be made to the appended claims, rather than to the foregoing specification as indicating the scope of the invention.

I claim:

1. An apparatus for playing an educational and entertaining game, comprising:

means for displaying a plurality of predetermined designs to be used in playing the game;

game means for producing by chance determining means combinations of elements of a first type and elements of a second type, said game means including a deck of cards having combinations of one of a plurality of elements of a first type and one of a plurality of elements of a second type; and score means for each player to form one of said plurality of predetermined designs in playing the game, said score means being comprised of a grid with areas located in the grid identified by said elements in the first type along one side and said elements of a second type along perpendicular side whereby particular areas may be allocated in response to the player obtaining particular combinations of elements of the first and second types by use of the game means whereby one of the particular designs may be formed on the score means.

2. Apparatus for playing a game in accordance with claim 1 in which said score means for each player is comprised of a grid of (*n*) elements of one type along one side and (*m*) elements of a second type along a perpendicular side where (*n*) is a first predetermined number and (*m*) is a second predetermined number, and wherein said deck of cards is comprised of (*n*)(*m*) cards where (*n*)(*m*) is the product of (*n*) and (*m*).

3. Apparatus for playing a game in accordance with claim 1 wherein said means for displaying a plurality of predetermined designs includes a plurality of guide cards, each guide card containing at least one score card with a predetermined design formed on the grid thereof.

4. Apparatus for playing an educational and entertaining game, comprising:

a game board having a plurality of consecutively arranged segments, each of said plurality of segments being allocated to one of a plurality of elements of a first type and one of a plurality of elements of a second type;

playing piece means for each player of the game;

means for determining a chance result;

a plurality of cards, each of said plurality of cards being identified with a combination of one of the plurality of elements of a first type and one of the plurality of elements of a second type; and a score card for each player, comprised of a grid with areas located in the grid identified by elements of the first type along one side and elements of the second type along a perpendicular side whereby particular areas may be allocated in resonse to the player obtaining combinations of elements of said first and second types by use of the chance determining means and the game board or by use of the cards whereby particular designs may be formed on the score card.

5. Apparatus for playing a game in accordance with claim 4 wherein the score card for each player is comprised of a grid with the areas located in the grid identified by (*n*) elements of a first type along one side and (*m*) elements of a second type along a perpendicular side, where (*n*) is a first predetermined number and (*m*) is a second predetermined number, and wherein said plurality of cards is comprised of (*n*)(*m*) cards each being identified with a combination of one of (*n*) elements of the first type and one of (*m*) elements of the second type.

6. Apparatus for playing an educational and entertaining game concerning astrology, comprising:

a game board having a plurality of consecutively arranged segments, each of said plurality of segments being allocated to one of the signs of the zodiac, a starting segment, one of the four astrological elements, or one of a predetermined number of neutral segments; said segments allocated to the signs of the zodiac being further identified with a characteristic of the particular sign of the zodiac;

playing piece means for each player of the game;

means for determining a chance result;

a plurality of cards, each of said plurality of cards being identified with a combination of one of the signs of the zodiac and one of the characteristics of such signs; and, a score card for each player, comprised of a grid with areas located in the grid identified by the zodiac signs along one side and the characteristics along a perpendicular side whereby particular areas may be allocated in response to the player obtaining a particular sign and characteristic by use of the chance determining means and the game board or the cards whereby particular designs may be formed on the score card.

7. Apparatus for playing a game concerning astrology in accordance with claim 6 wherein said game board is comprised of thirty-two segments.

8. Apparatus for playing a game concerning astrology in accordance with claim 6 wherein each of four cards is allocated to one of the astrological elements and includes indicia allocating the card to three possible zodiac signs.

9. An apparatus for playing a game concerning astrology in accordance with claim 6 which includes a plurality of guide cards, each guide card containing three score card grids and representing three different zodiac signs.

10. An apparatus for playing a game concerning astrology in accordance with claim 6 wherein said plurality of cards comprises a deck of cards comprised of (*n*) times twelve cards wherein (*n*) is a number corresponding to the number of different characteristics used in the game.

11. An apparatus for playing a game concerning astrology in accordance with claim 6 in which said plurality of cards comprises a deck of 72 cards, one card being allocated for each combination of one of six characteristics and one of twelve zodiac signs.

12. An apparatus for playing a game concerning astrology in accordance with claim 6 in which said score card grid is comprised of a twelve by (*n*) matrix, where (*n*) is the number of characteristics used in the game.

13. An apparatus for playing a game concerning astrology in accordance with claim 6 wherein said score card grid is comprised of a twelve by six matrix, said grid being identified by the twelve zodiac signs along one axis and six characteristics of the zodiac signs along a perpendicular axis.

14. Apparatus for playing a game concerning astrology in accordance with claim 6 wherein said arrangement of segments is circular.

* * * * *